US005333737A

United States Patent [19]

Clark

[11] Patent Number: 5,333,737

[45] Date of Patent: Aug. 2, 1994

[54] PACKAGING SYSTEM FOR TWO PART EPOXY ADHESIVES AND THE LIKE

[75] Inventor: Bryan J. Clark, Brookfield, Wis.

[73] Assignee: Power Poxy Adhesives, Inc., New Berlin, Wis.

[21] Appl. No.: 932,442

[22] Filed: Aug. 19, 1992

[51] Int. Cl.[5] ..... B65D 69/00

[52] U.S. Cl. ..... 206/568; 206/219; 206/229

[58] Field of Search ..... 206/219, 221, 232, 229, 206/568, 582, 804

[56] References Cited

U.S. PATENT DOCUMENTS

| | | | |
|---|---|---|---|
| 2,047,090 | 7/1936 | Woolfson | 206/804 |
| 2,874,707 | 2/1959 | Koppel | 206/229 |
| 3,083,821 | 4/1963 | Woodson | 206/568 |
| 3,141,549 | 7/1964 | Koehler | 206/232 |
| 3,315,689 | 4/1967 | Melik | 206/229 |
| 3,638,785 | 2/1972 | Casteel et al. | 206/229 |
| 3,682,179 | 8/1972 | Firth et al. | 206/582 |
| 3,747,744 | 7/1973 | Reed, Jr. | 206/229 |
| 4,341,302 | 7/1982 | Baker et al. | 206/568 |
| 4,364,473 | 12/1982 | Bogaert | 206/568 |

FOREIGN PATENT DOCUMENTS

| | | | |
|---|---|---|---|
| 1426780 | 3/1976 | United Kingdom | 206/219 |

*Primary Examiner*—David T. Fidei

*Attorney, Agent, or Firm*—Reinhart, Boerner, Van Deuren, Norris & Rieselbach

[57] ABSTRACT

A package for adhesives having first and second parts including a card slideable within a box, premeasured adhesive portions in compartments shaped to conform to a dispensing and mixing paddle, and a mixing vessel dimensioned to receive the compartments therein. The card may be capable of interlocking engagement with the box to prevent card removal. The conformity of the compartment shape to the dispensing and mixing paddle allows substantially the entire contents of the compartment to be removed with one pass of the paddle.

13 Claims, 3 Drawing Sheets

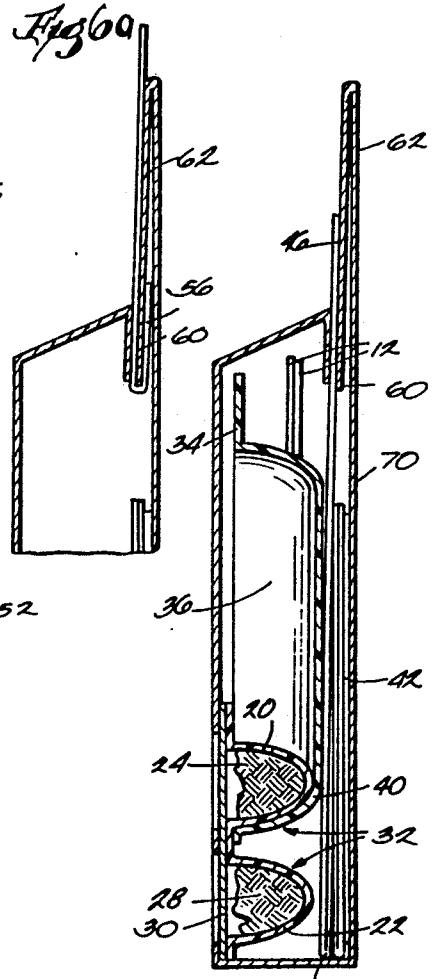
Fig. 6b
Fig. 6a
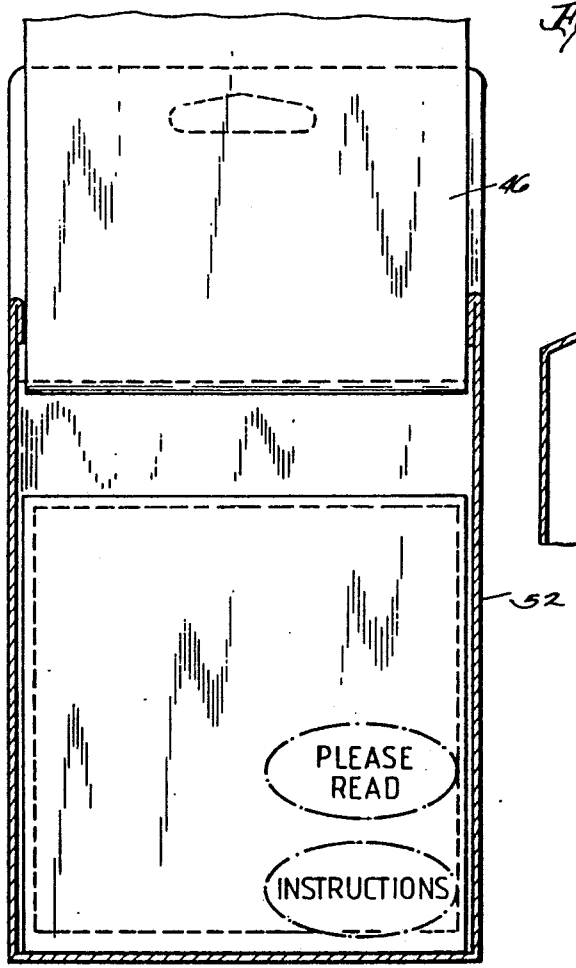
Fig. 5
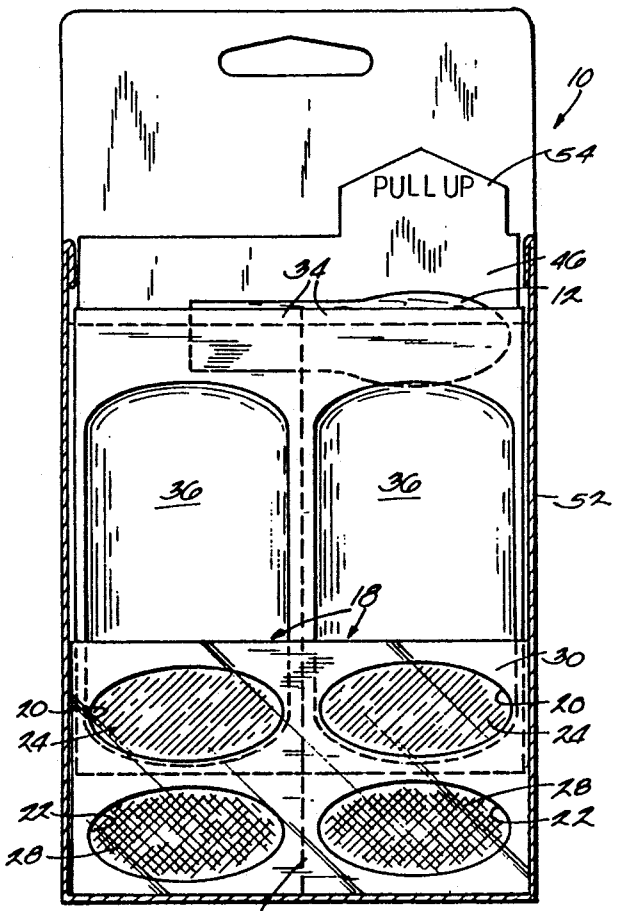
Fig. 4

PACKAGING SYSTEM FOR TWO PART EPOXY ADHESIVES AND THE LIKE

BACKGROUND OF THE INVENTION

This invention relates generally to packages and, more particularly, to packages for two part epoxy adhesives and the like.

Epoxy adhesives are highly versatile and are effective in a variety of applications. Such adhesives, as a rule, are supplied in two parts (a "resin" part and a "hardener") that must be mixed together immediately before use. The need to keep the two parts separate until immediately before use complicates the packaging for epoxy adhesives, and the need to measure and mix the two parts in equal volumes makes the use of epoxy adhesives somewhat more inconvenient than ready-to-use, one part adhesives. Because of these inherent difficulties, a variety of systems and methods have been proposed for packaging two part epoxy adhesives.

In one well-known system, the resin and hardener parts of the epoxy are packaged in separate squeeze tubes. The user is expected to squeeze equal amounts of the resin and hardener onto a suitable mixing surface, gauging the proper ratio more-or-less by eye. Although simple and inexpensive, this system has a number of drawbacks. First, because two separate tubes are provided, it is possible for one of the tubes to become misplaced or otherwise "lost." In this event, the remaining tube is of little use or value. Furthermore, because the proper ratio must be gauged by eye, a certain degree of skill and care is needed to ensure that the proper proportions of resin and hardener are obtained. Even relatively minor errors in the ratio of resin to hardener can compromise the strength of the final bond. Finally, when the usable portion of the epoxy adhesive has been consumed, there still remains some unmixed and uncured resin and hardener in the respective resin and hardener tubes. If these tubes are disposed of in a landfill, it is possible for the uncured resin and hardener to leech into the soil thereby contaminating the environment.

Another well-known packaging system includes a syringe-like container having two parallel, similarly dimensioned chambers and a plunger extending into each chamber. When the plunger is depressed, approximately equal quantities of resin and hardener are dispensed. Although this system is effective in providing a proper ratio of hardener to resin, the system is relatively expensive, and the actual weight of the package itself (typically made of molded polyethylene) sometimes exceeds that of the epoxy adhesive it contains. Furthermore, after use the package continues to contain some uncured resin and hardener, which makes the used package unsuitable for recycling or for disposal in a landfill.

In both these prior systems, it is necessary for the user to provide a suitable mixing surface as well as the implements needed to mix and apply the epoxy adhesive.

Further, because epoxy adhesives are so versatile, a means for providing additional information to the consumer is desirable. Prior art epoxy packaging systems have provided product information on the limited space available on the exterior of the packaging. Additional space for providing product information has long been needed. Practical and aesthetic considerations require the additional product information to be readily accessible to the consumer, to be provided in an attractive and easy to use device, and require the device to remain intact with the packaging system to prevent loss of the device and, consequently, unattractive messy product displays.

SUMMARY OF THE INVENTION

The invention provides a package for adhesives having first and second parts. The package includes a dispensing and mixing paddle having a predetermined peripheral shape at one end thereof. The package further includes a sheet having first and second depressions formed therein, each of the depressions having a cross-sectional shape conforming to the predetermined peripheral shape of the dispensing and mixing paddle. A predetermined quantity of the first part of the adhesive is contained within the first depression while a predetermined quantity of the second part of the adhesive is contained in the second depression. The predetermined quantities of the first and second parts of the adhesive are in a predetermined ratio of the first part to the second part. The package further includes a removable cover membrane overlying the sheet and forming a removable seal over each of the first and second depressions. Means are provided for removably retaining the dispensing and mixing paddle with the sheet. The cross-sectional shapes of the first and second depressions, and the peripheral shape of the dispensing and mixing paddle are such that substantially the entire contents of each of the first and second depressions can be removed with a single pass of the dispensing and mixing paddle along the first and second depressions.

The invention also provides a package for two part epoxy adhesives wherein the package includes a box and a first sheet dimensioned to be received within the box. The first sheet includes first and second depressions formed therein, each of the first and second depressions having a predetermined cross-sectional shape and a predetermined volume. A cover membrane overlies the first sheet to form, in conjunction with the first sheet, first and second sealed compartments defined by the first or second depressions on one side and by the cover member on the other side. A second sheet, having substantially the same peripheral size and shape as the first sheet includes a depression dimensioned to receive therein the first and second depressions of the first sheet. The depression of the second sheet has a volume at least as great as the combined volumes of the first and second compartments. The package further includes a dispensing and mixing paddle having one end shaped to conform to the cross-sectional shape of the first and second depressions. The box is dimensioned to receive therein the first and second sheets and the dispensing and mixing paddle to form a unitary assembly that can be disassembled when the adhesive contained therein is to be used.

The package further includes a card dimensioned to be received within the box. The card includes a pull tab located at the periphery of the card. The tab extends generally beyond a portion of the box when the card is fully inserted into the sleeve and thus may be grasped to slide the card out of the sleeve. A folded lower edge portion of the card engages the upper flap of the box to prevent removal of the card. Suggested applications of the package contents or other information may be printed on the card.

It is a general object of the present invention to provide a new and improved packaging system for two part epoxy adhesives and the like.

It is a further object of the present invention to provide a packaging system for epoxy adhesives that includes a way of providing additional product information to the consumer while minimizing packaging system manufacturing cost.

It is a still further object of the present invention to provide a packaging system for epoxy adhesives that utilizes a minimum of packaging material to minimize expense, waste and adverse impact on the environment.

It is a still further object of the present invention to provide a packaging system for epoxy adhesives that makes it simple and convenient to achieve the proper ratio of hardener to resin.

It is a still further object of the present invention to provide a packaging system for epoxy adhesives that includes, in one package, all the utensils and materials needed to make an epoxy repair.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, wherein like reference numerals identify like elements, and wherein:

FIG. 4 is a cross-sectional view of the packaging system shown in FIG. 1.

FIG. 5 is a top view of the packaging system shown in FIG. 1 with the card in its extended position.

FIG. 6 is a cross section of the packaging system shown in FIG. 1, showing the tab in locking engagement with the upper box flap.

DESCRIPTION OF THE PREFERRED EMBODIMENT

Figure 1:
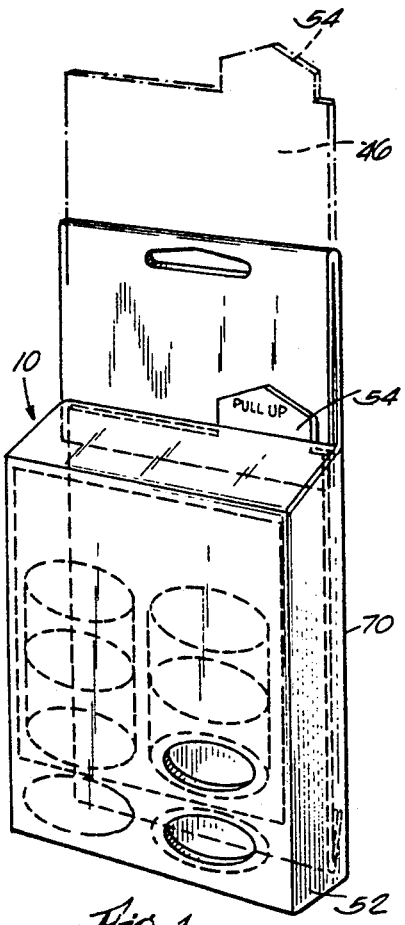
FIG. 1 is a perspective view of a packaging system constructed in accordance with one aspect of the invention.
Figure 2:
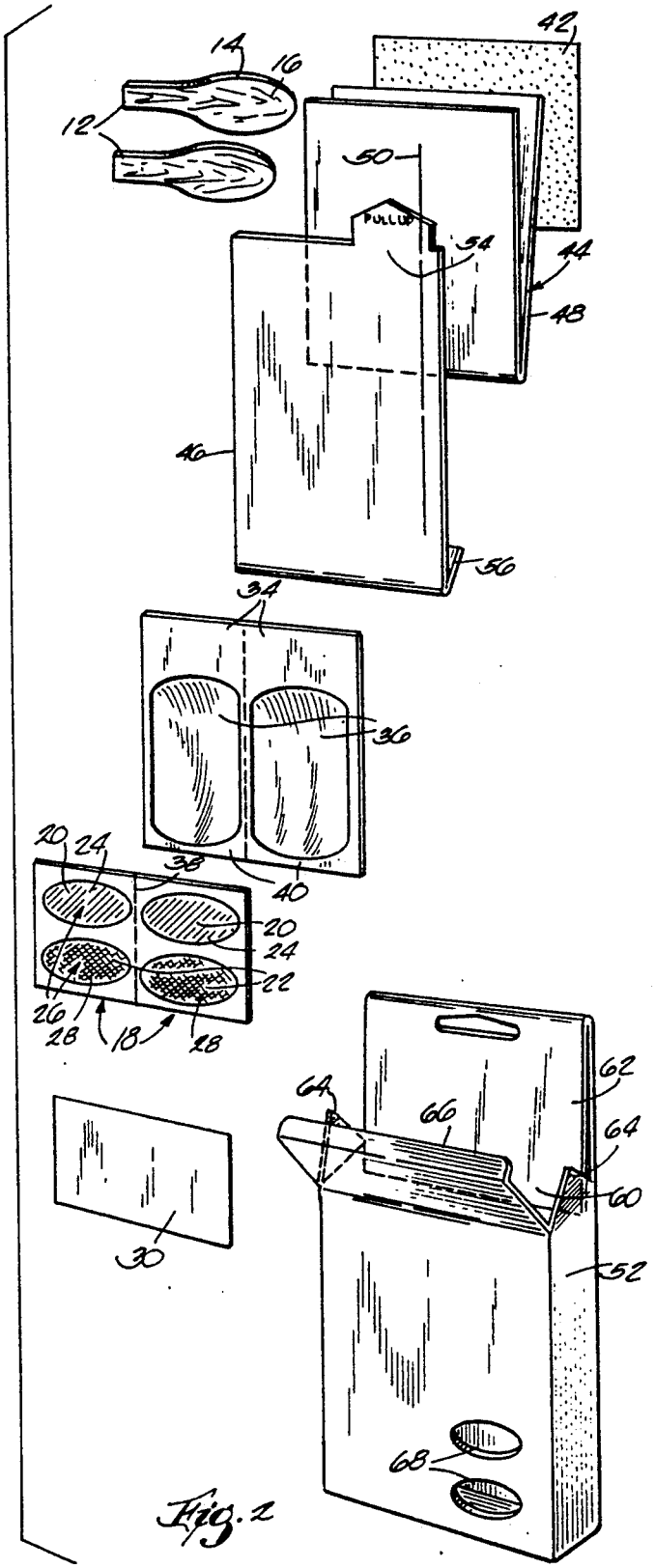
FIG. 2 is an exploded perspective view of the packaging system shown in FIG. 1, showing the component parts thereof.

Referring to the drawings, and more particularly to FIG. 1, a package constructed in accordance with one aspect of the invention is indicated generally at 10. Referring to FIG. 2, two dispensing and mixing paddles 12 are included in the package. Each dispensing and mixing paddle 12 has a pre-determined peripheral shape 14 at one end 16. The dispensing and mixing paddle 12 may be formed of wood or other substantially rigid materials. The package further includes a sheet 18 preferably formed of high impact polystyrene having first 20 and second 22 depressions formed therein, with each of the depressions having a cross-sectional shape conforming to the pre-determined peripheral shape of the dispensing and mixing paddle. One-quarter of one ounce of the first part 24 of the adhesive 26 (e.g., the resin) is contained within the first depression 20 and one-quarter ounce of the second part 28 of the adhesive 26 (e.g., the hardener) is contained in the second depression 22. The cross-sectional shapes of the first 20 and second 22 depressions, and the peripheral shape 14 of the dispensing and mixing paddle 12 are such that substantially the entire contents of each of the first 20 and second 22 depressions can be removed with a single pass of the dispensing and mixing paddle 12 along each of the first 20 and second 22 depressions. This helps to ensure that the ratio of the first 24 and second 28 parts of the adhesive 26 in the final mixture is maintained.

As shown in FIG. 6, a removable cover membrane 30 preferably formed of polyethylene terephthalate ("PET") or other suitable material overlies the sheet and forms a removable seal over each of the first 20 and second 22 depressions and their contents. Thus, first and second sealed compartments 32 are defined by the first 20 and second 22 depressions on one side and by the cover membrane 30 on the other side.

A second sheet 34, having substantially the same peripheral size and shape as the first sheet 18 includes a depression 36 dimensioned to receive therein the first 20 and second 22 depressions of the first sheet 18. Accordingly, the depression 36 of the second sheet 34 has a volume at least as great as the combined volumes of the first and second compartments 32. This configuration of the depression 36 of the second sheet 34 forms a mixing vessel for the first and second parts of the epoxy adhesive 26. Each mixing vessel fits easily in the consumer's hand for convenient use.

In the preferred embodiment of one aspect of the invention, two first sheets 18 are joined at their sides at the joint 38 as shown in FIG. 2. The joint 38 is perforated to allow the sheets to be readily separated. Referring to FIGS. 2, 4 and 6, two second sheets 34 are also joined at their sides to receive the joined first sheets 18 therein. The first sheets 18 are placed within the depressions 36 of the second sheets 34 so that half of the compartments 32 of the first sheets 18 are contained with the depressions 36 of the second sheet 34. The other compartments 32 of the first sheet 18 are retained in a position past the bottom edges 40 of the second sheet 34 depressions 36 as shown in FIG. 6. The first sheet 18 compartments 32 are thereby prevented from shifting in the interiors of the second sheets' 34 depressions 36 and the package 10.

Figure 3:
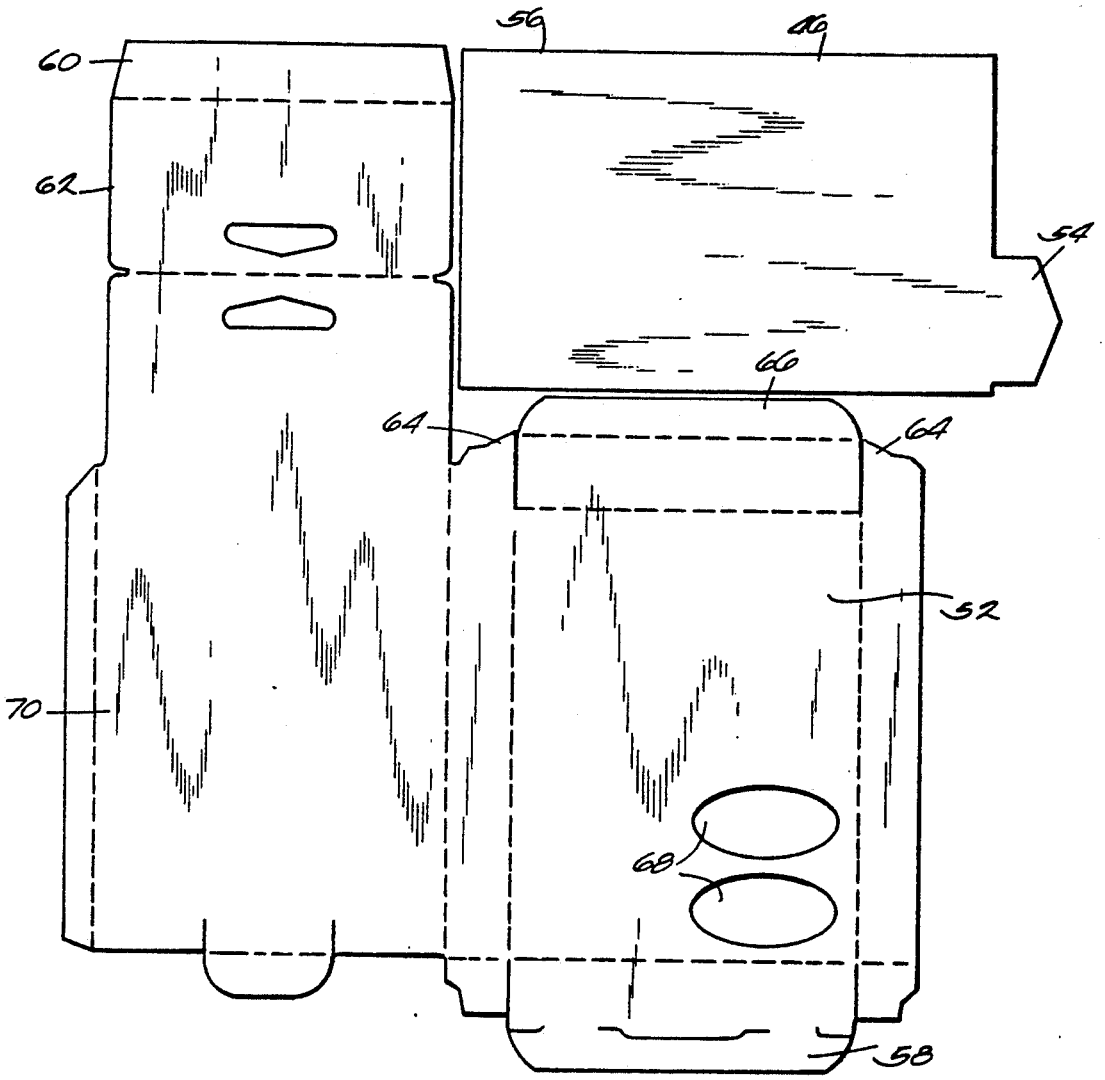
FIG. 3 is a plan view of a blank formed in accordance with one aspect of the invention useful in understanding one way the box and card may be cut from a single sheet of material in order to minimize waste.

The package 10 further includes a piece of sandpaper 42, a tips brochure 44 and a card 46. The tips brochure 44, which contains helpful hints on the use of the epoxy adhesive 26, comprises a paper sheet 48 that is folded in half among its major axis 50. It should be noted that the tips brochure 44 is not necessary to the package 10 system and may be omitted if desired. The card 46 comprises cardboard or similar materials and is dimensioned to be received within the box 52. The box 52 is preferably formed of the same material as the card 46. As shown in FIG. 3, the card 46 utilizes material which would otherwise typically be wasted in the die-cutting process for the box 52.

The card 46 has a tab 54 extending from its peripheral edge as shown in FIGS. 1 through 4. The bottom edge 56 of the card 46 is folded as shown in FIGS. 2 and 6, and the card 46 is slideably received within the box 52. The card 46 may be inserted into the tips brochure 44 to prevent interference with any lower box flaps 58 or other package contents. As the card 46 is slid upwards, its folded bottom edge 56 slides out of the brochure 44 and engages the lower edge 60 of the upper hanging flap 62 of the box 52 as shown in FIGS. 1 and 6. This locking engagement allows the consumer to view the recommended uses of the package 10 contents on the card 46 while still retaining the card 46 securely to the package 10.

The box 52 is dimensioned to receive the components previously described. While a locking flap configuration has been shown, it is obvious to one skilled in the art that a gummed flap configuration may be used as well. The upper sides 64 of the box 52 are angled so that the upper flap 66 of the box 52 remains elevated. This elevation allows the consumer to more easily read any printing on the upper flap 66 and provides an aesthetically pleasing package appearance. The box 52 also includes two elliptical portions 68 cut from the box 52 face. This allows the consumer to inspect the first and second compartment 32 contents and view printing on the cover membrane 30 when the package is sealed. When the first 18 and second 34 sheets are removed from the package 10, printing on the tips brochure 44 may be seen through the cutout portions 68 and alerts the consumer of the brochure's presence.

The package 10 contents are arranged for easy assembly and efficient space utilization. First, the sandpaper 42 is inserted into the box 52 against the rear side 70 of the box 52. Next, the card 46 is inserted into the tips brochure 44 and the two compartments 32 are placed into the box 52 adjacent to the sandpaper 42. Half of the first sheet 18 contents are placed into the second sheet depressions 36 as previously described. The dispensing and mixing paddles 12 are then placed on top of the second sheets 34. Accordingly, everything the consumer requires to mix and apply the adhesive 26 is contained in the package.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

What is claimed is:

1. A package for adhesives having first and second parts, said package comprising:

a dispensing and mixing paddle having a peripheral shape at one end thereof;

a sheet having first and second depressions formed therein, each of said depressions having a cross-sectional shape conforming to said peripheral shape of said dispensing and mixing paddle;

a quantity of said first part of said adhesive in said first depression;

a quantity of said second part of said adhesive in said second depression, said quantities of said first and second parts of said adhesive being in a ratio of said first part to said second part;

a removable cover membrane overlying said sheet and forming a removable seal over each of said first and second depression; and means for removably retaining said dispensing and mixing paddle with said sheet;

said cross-sectional shapes of said first and second depressions and said peripheral shape of said dispensing and mixing paddle being such that substantially the entire contents of each of said first and second depressions can be removed with a single pass of said dispensing and mixing paddle along said first and second depressions.

2. A package as defined in claim 1 wherein said sheet includes a plurality of said first depressions and a plurality of said second depressions and further includes means for separating said sheet along lines dividing said pluralities of said first and second depressions into pairs, each of said pairs containing one of said first depressions and one of said second depressions.

3. A package as defined in claim 2 wherein said means for removably retaining said dispensing and mixing paddle comprises a box dimensioned to slide over said sheet and said removable cover membrane.

4. A package as defined in claim 1 wherein said peripheral shape at one end of said dispensing and mixing paddle is substantially elliptical.

5. A package as defined in claim 4 wherein each of said first and second depressions has substantially the shape of one half of an egg divided in two along its major axis.

6. A package as defined in claim 5 wherein said first and second depressions contain sufficient quantities of said first and second parts for substantially one single use.

7. A package as defined in claim 1 wherein said package further includes an additional sheet having a single depression formed therein, said single depression serving as a mixing vessel for the epoxy adhesive and having a volume equal to or greater than the combined volumes of said first and second depressions.

8. A package as defined in claim 7 wherein said single depression is configured to receive therein said first and second depressions.

9. A package for two part epoxy adhesives, said package comprising:

a box;

a first sheet dimensioned to be received within said box, said first sheet including first and second depressions formed therein, each of said first and second depressions having a cross-sectional shape and a volume;

a cover membrane overlying said first sheet to form, in conjunction with said first sheet, first and second sealed compartments defined by said first and second depressions on one side and by said cover membrane on the other side;

a second sheet having substantially the same peripheral size and shape as said first sheet and having a depressions dimensioned to receive therein said first and second depression of said first sheet, said depression of said second sheet having a volume at least as great as the combined volumes of said first and second compartments; and a dispensing and mixing paddle having one end shaped to conform to the cross-sectional shape of said first and second depressions;

said box being dimensioned to receive therein said first and second sheets and said dispensing and mixing paddle to form a unitary assembly that can be disassembled when the two part epoxy adhesive contained therein is to be used.

10. A package as defined in claim 10 wherein said first and second sheets are formed of high impact polystyrene.

11. A package as defined in claim 10, further comprising:

a card having a tab located substantially at its periphery;

said card being dimensioned to be received substantially within said box with said tab extending generally from a portion of said box; and said card being slideable with respect to said box.

12. A package as defined in claim 10 wherein said first sheet includes a plurality of said first depressions and a plurality of said second depressions and further includes means for separating said first sheet along predetermined lines dividing said pluralities of said first and second depressions into pairs, each of said pairs containing one of said first depressions and one of said second depressions.

13. A package as defined in claim 11, wherein said card includes a folded lower edge capable of locking engagement with a portion of said box.

* * * * *